United States Patent [19]

Marino et al.

[11] 4,251,095

[45] Feb. 17, 1981

[54] LATCH ASSEMBLY

[75] Inventors: Jerry C. Marino; Edward C. Fortini, both of Sudbury, Mass.

[73] Assignee: Data General Corporation, Westboro, Mass.

[21] Appl. No.: 24,897

[22] Filed: Mar. 29, 1979

[51] Int. Cl.[3] ..... E05C 3/14

[52] U.S. Cl. ..... 292/54; 292/202

[58] Field of Search ..... 292/228, 54, 304, DIG. 14, 292/DIG. 49, DIG. 55, 202

[56] References Cited

U.S. PATENT DOCUMENTS

| | | | |
|---|---|---|---|
| 1,304,244 | 5/1919 | Appleby | 292/DIG. 23 |
| 1,602,383 | 10/1926 | Andersson | 292/304 X |
| 2,589,776 | 3/1952 | Colgrove | 292/304 X |
| 2,841,430 | 7/1958 | Krause | 292/DIG. 14 |
| 3,893,207 | 7/1975 | Rudaitis et al. | 292/DIG. 14 X |

*Primary Examiner*—Richard E. Moore

*Attorney, Agent, or Firm*—Donald Brown

[57] ABSTRACT

The combination with a cabinet structure containing one or more openings and cover panels for covering the openings of latch assemblies at the two opposite sides of the opening, each comprising a pilot fixed to the cabinet structure and a receptacle fixed to the cover panel which, when interengaged, position the cover panel over the opening, a spring-biased latch member pivotally mounted to the cover panel for interengagement with the pilot and a knob fixed to the distal end of the latch member and extending through a slot in the cover panel for disengaging the latch member from the pilot.

15 Claims, 7 Drawing Figures

LATCH ASSEMBLY

BACKGROUND OF THE INVENTION

Conventionally, computer cabinets, television cabinets and the like are provided with removably mounted panels to permit ready access thereto and quarter turn type fasteners are used for this purpose. Such latches as are available must be manually turned into and out of locking position and frequently require the use of a tool, are somewhat obtrusive and unattractive and require that the panel be accurately aligned before they can be engaged. The latching means of this invention is designed to align the cover panel with the opening which it is to cover, to be self-latching, and to fit into a limited space.

SUMMARY OF THE INVENTION

As herein illustrated, the invention comprises in combination with a structural part containing an opening and a cover panel for covering the same, latch assemblies, the component parts of which are attached to the structural part and to the cover panel at two opposite sides of the opening. Each assembly comprises a pilot fixed to the structural part with its axis perpendicular to the plane of the opening and with its distal end facing outwardly. Each pilot comprises a head, a tapering point at one end and a shank of reduced cross section at its other end defining with the head a rearwardly-facing shoulder. A receptacle is fixed to the inner side of the cover panel for receiving the pilot and said pilots and receptacles, when interengaged, position the cover panel relative to the opening. A latch is mounted at one end to the inner side of each respective side of the cover panel for pivotal movement about an axis spaced from and parallel to the axis of the pilot when the cover panel is mounted over the opening by interengagement of the pilot and receptacle so that its distal end will become engaged with the shoulder, spring means biasing the latch member about said axis in the direction to engage the latch behind the shoulder, and means at the distal end of the latch member for disengaging the latch member from the shoulder. The receptacle at the inner side of the cover plate is a block containing a smooth bore hole dimensioned to receive the head of the pilot. The block contains a threaded hole parallel to the smooth bore hole and a screw threaded stud is screwed into the threaded hole and rotatably supports the latch member, the latter being provided at one end with a hole for receiving the screw threaded stud. A coiled spring mounted to the stud with one end fixed and the other end stressed in compression against the latch arm spring-biases the latch member in a direction to become engaged with a shoulder at the rear end of the pilot and, desirably, has at the side facing the pilot a concave deviation for engagement with the shank of the pilot. At the distal end of the latch member, there is a stake for receiving a knob and the cover plate contains a hole through which the knob extends and by means of which the latch member may be disengaged from the pilot. The latch member may be a rigid arm or a flexible wire coiled at one end to provide a spring for biasing, bent intermediate its ends to provide a deviation therein for interengagement with the shank of the pilot and bent at its distal end to receive the knob by means of which it may be disengaged from the pilot.

The invention will now be described in greater detail with reference to the accompanying drawings, wherein.

Figure 1:
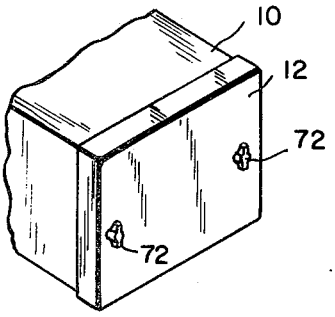
FIG. 1 is a fragmentary perspective of a cabinet structure to one open end of which is attached a cover panel.
Figure 2:
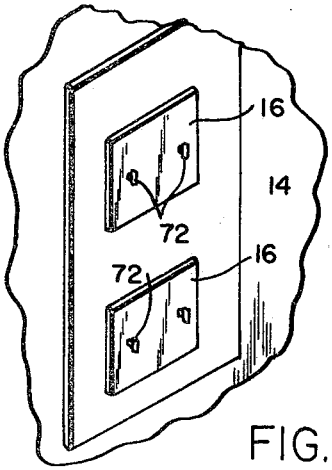
FIG. 2 is a perspective of a panel board containing one or more openings providing access to the rear side thereof with cover panels attached over the openings.

Referring to the drawings, FIGS. 1 and 2 shown in perspective, for example, a cabinet 10 for a computer or television with a cover 12 or a panel board 14 with covers 16 to provide access to electrical installations behind the panel for which the latch assemblies of this invention are especially designed to enable easily positioning the covers over the openings in self-aligning relation thereto and to be self-locking. Generally, there are two latch assemblies, the component parts of which are positioned, respectively, at opposite sides of the opening to which the cover is to be applied and at opposite sides of the cover.

Figure 3:
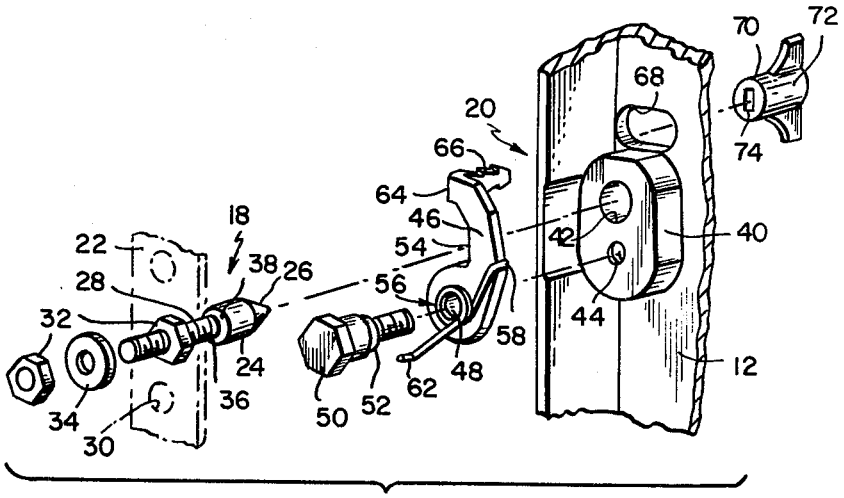
FIG. 3 is an exploded perspective of the latch assembly shown in conjunction with fragmentary parts of the structure with which it is used.
Figure 6:
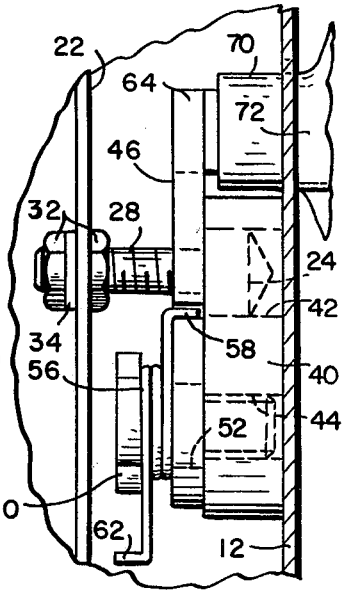
FIG. 6 is a side elevation taken on the line 6—6 of FIG. 5.

Referring specifically to FIGS. 3 and 6 inclusive, each latch assembly comprises components 18 and 20 which are mounted, respectively, to the cabinet structure and to the cover panel.

The component 18 is mounted to the cabinet structure or to the rear side of the wall panel by means of a bracket member 22 and is provided with a head, a tapered or conical tip 26 and a screw threaded shank 28 of reduced cross section. The pilot is mounted to the bracket 22 by inserting the shank through a hole 30 therein and securing it with nuts 32—32 and a washer 34 with its axis perpendicular to the plane of the opening to which the cover is to be applied and with the head spaced forwardly of the bracket.

The reduced diameter of the shank 28 provides at the rear side of the pilot rearwardly of the head 24 in conjunction with the blanket 22 to which it is fixed, a recess 36 circularly of the shank and a shoulder 38 perpendicular to the axis of the pilot.

The component 20 comprises a block 40 fixed to the inner side of the cover 12 or 16 and contains spaced, parallel openings 42 and 44, FIG. 3. The opening 42 is of smooth bore and is dimensioned to receive the head of the pilot 24 so that, when interengaged, the cover is properly positioned with respect to the opening. The conical end 26 of the pilot serves to automatically guide the cover into its proper position and to displace the latch arm and hold it displaced while the cover is being positioned. The component 20 comprises in addition a latch member 46 which has at one end a smooth bore hole 48 by means of which it is rotatably mounted to the block 40 on a screw threaded stud 50 which is inserted through the hole 48 and screwed into the threaded opening 44. The screw threaded stud has a smooth bearing surface 52 for rotatable engagement with the smooth bore hole 48 of the latch member and supports the latch member for rotation in a plane perpendicular to the axis of the pilot. Midway between the ends of the latch member there is at the edge facing the pilot a concave deviation 54 for engagement within the recess 36 behind the shoulder 38. The latch member 46 is spring-biased into engagement with the shank at the bottom of the recess 36 by a spring 56 mounted on the stud 50 with one end 58 engaged within a notch 60 in the edge of the latch member at the opposite side from the deviation 54 and the other end 62 engaged with a portion of the cover so as to be held stationary. The spring 56 is mounted in compression so that it biases the latch arm toward the pilot.

Figure 5:
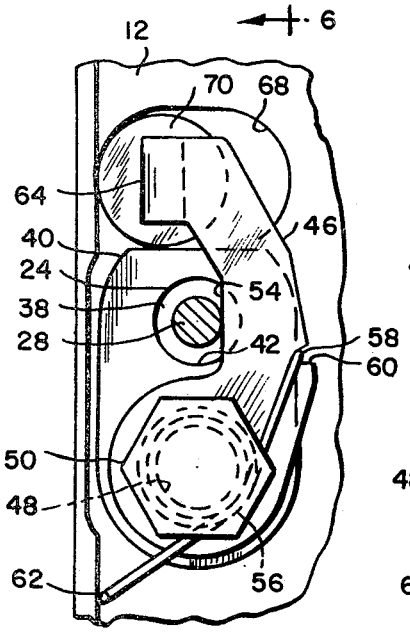
FIG. 5 is a view similar to FIG. 4 showing in addition the component part of the latch assembly which is fixed to the cabinet structure.
Figure 4:
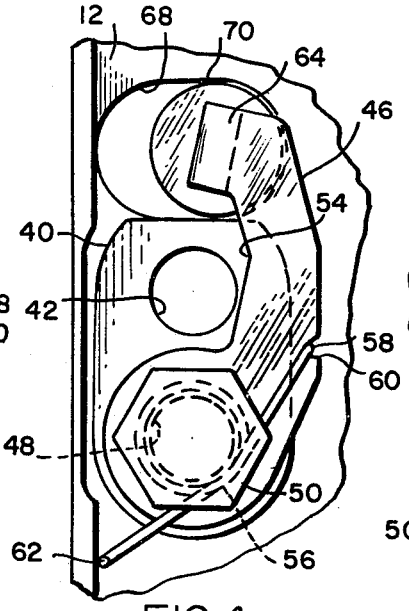
FIG. 4 is an elevation of the inner side of the cover plate showing that portion of the latch assembly which is attached thereto with the latch disengaged from its latching position.

At the distal end of the latch member 46, there is a stake 66 disposed at right angles thereto and the cover is provided with a transversely-elongate slot 68 for receiving the barrel 70 of a key 72 which is fixed to the lever by engagement of the stake 56 within a hole 74 formed in the barrel. The elongate slot 68 as shown in FIGS. 4 and 5 permits the key to move to the left-hand side of the slot for engagement of the spring-biased latch member with the recess in the pilot. Movement of the key from left to right as shown in FIG. 4 against the opposition of the spring-biasing permits the latch means to be disengaged from the pilot.

Figure 7:
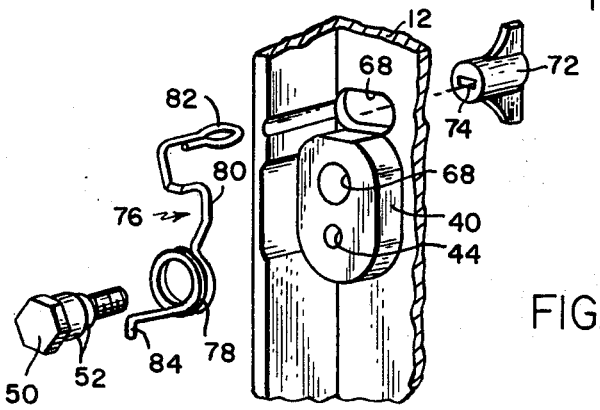
FIG. 7 is a fragmentary perspective of an alternative form of the latch assembly.

Instead of the latch member 46 which is a rigid arm, a spring member 76, FIG. 7, may be employed comprised of a length of resilient wire provided with a coil 78 at one end, a deviation 80 between its ends, and an eye 82 at its distal end. The coil 78 is mounted to the block 40 with the tail end of the spring fixed and with the wire stressed so as to enter the recess 36 behind the shoulder 38. The eye 82 at the distal end is pressed into the slot 74 in the key 72. As in the previously described latch assembly, when the cover is applied, the conical end of the pilot displaces the latch member and holds the latter displaced until the pilot becomes engaged within the hole 42, whereupon the latch arm springs into the recess 36 behind the shoulder 38 into locking position.

From the foregoing, it is apparent that the latch assembly is of very simple construction, inexpensive to manufacture, adaptable to most any structure wherein it is desirable to apply a cover panel or plate to an opening, occupies a minimum of space and is unobtrusive.

It should be understood that the present disclosure is for the purpose of illustration only and includes all modifications or improvements which fall within the scope of the appended claims.

What is claimed is:

1. A latch assembly for removably mounting a cover plate to a cabinet containing an opening structured to receive a cover plate to cover the same, comprising at each of two respective sides of the cover plate and opening, a pilot having a tapered forward end and rearwardly thereof a shoulder perpendicular to its longitudinal axis, means to which the pilot is fixed to the cabinet structure in a position such that its tapered end extends from the cabinet structure through said opening substantially perpendicular to the plane of the opening, a receptacle secured to the inner side of the cover plate for receiving the pilot to position the cover plate in relation to the opening in the cabinet structure, a latch pivotally connected at one end to the cover plate for movement about an axis spaced from and parallel to the axis of the pilot in a plane at right angles to said axis and so positioned that when the pilot is engaged with the receptacle, the distal end of the latch will become engaged with the pilot behind the shoulder, spring means biasing the latch in a direction to cause it to enter behind the shoulder recess when the cover plate is positioned to cover the opening and means at the distal end of the latch for withdrawing it from engagement with the shoulder recess to thus release the cover plate for removal from the cabinet.

2. A latch assembly for removably mounting a cover plate to a cabinet structure comprising at each of two corresponding sides of the cover plate and cabinet structure a pilot fixed to the cabinet structure containing rearwardly of its distal end a shoulder, means at the inner side of the cover plate defining an opening for receiving the pilot cover, said pilot and said means, when interengaged, determining the position of the cover plate relative to the cabinet structure, a latch mounted at one end to the cover plate for pivotal movement about an axis spaced from and parallel to the axis of the pilot in a plane when the cover plate is positioned such that its distal end will become engaged with the pilot behind the shoulder, spring means biasing the latch in a direction to cause it to become engaged with the shoulder by positioning of the cover plate on the cabinet, said cover plate containing an opening, and means extending from the distal end of the latch through said opening in the cover plate for withdrawing the latch from the shoulder.

3. A latch assembly according to claim 2 wherein the means at the inner side of the cover defining an opening is a block attached to the inner side of the cover plate containing a smooth bore hole and the pilot is of a cross section to be received in said hole and has a tapering end to guide it into said hole.

4. A latch assembly according to claim 2 wherein the latch is a rigid arm, the plane of which is perpendicular to the axis of rotation and has a concave deviation in the edge which is spring-biased toward the pilot for interengagement with the shoulder on the pilot.

5. A latch assembly according to claim 3 wherein the latch is pivotally mounted to the block.

6. The combination with a box provided with an open side and a cover for covering said open side, latch means at each of two sides of the opening and cover for removably mounting the cover to the box in covering position comprising at each of the respective sides, a pilot fixed at one end to the box in a position such that its distal end faces the open side and with its axis substantially perpendicular to the plane of the open side, said pilot containing rearwardly of its distal end a shoulder, a receptacle fixed to the inner side of the cover for receiving the pilot, said pilots and receptacles when engaged positioning the cover in covering relation to the opening, a spring-biased latch mounted at one end to the cover plate for movement in a plane perpendicular to the axis of the pilot such that when the cover is placed over the opening, the distal end of the latch becomes engaged with the shoulder, and means at the distal end of the latch for disengaging it from the shoulder.

7. The combination of a cabinet structure with one or more openings for access to the interior thereof and provided with cover panels corresponding in number to the openings to cover the same, latch assemblies for removably mounting the covers to the cabinet structure over the respective openings, there being two such latch assemblies for each cover panel, each latch assembly comprising pilot fixed at one end to the cabinet structure adjacent a side of the opening in a position such that its axis is substantially parallel to the plane of the opening and its distal end faces outwardly, a receptacle fixed to the inner side of the cover panel at an edge corresponding to the side of the opening with which it will be disposed when covering the opening, containing a hole for receiving the pilot, said pilot and receptacle at the respective sides when interengaged positioning the cover panel in a predetermined covering position, each pilot comprising a head and shank of reduced cross section defining at the rear end of the head a rearwardly facing shoulder perpendicular to the axis, a spring-biased latch member mounted to the inner side of the cover panel for movement in a plane perpendicular to the axis of the pilot and in a direction to become engaged behind the shoulder of the pilot by mounting of the cover panel to the cabinet structure, said cover panel containing a slot in alignment with the distal end of the latch member and means extending from the distal end of the latch member through the slot for disengaging the distal end of the latch member from the shoulder.

8. The combination according to claim 6 wherein the slot is elongate in the direction of arcuate movement of the distal end of the latch member.

9. The combination according to claim 6 wherein the latch member is a rigid arm having at one end a hole, is pivotally mounted to the cover panel by means of a stud screwed to the cover panel and is spring-biased by a coil spring mounted to the stud with one end bearing against the arm and the other end fixed with respect to the cover panel.

10. The combination according to claim 8 wherein the arm has at the side facing the pilot a concave deviation for interengagement with the shank of the pilot behind the shoulder.

11. The combination according to claim 6 wherein the means at the distal end of the latch member comprises a stake fixed to the distal end of the arm and perpendicular thereto and a knob impaled upon the stake.

12. The combination according to claim 8 wherein the latch member is a spring member comprising a coil at one end, pivotally mounted to the cover panel by means of a stud screwed to the cover panel, and a flexible spring arm extending therefrom containing a concave deviation for interengagement with the shank of the pilot behind the shoulder and at its distal end a bent end.

13. The combination with a structural part containing an opening and a cover panel for covering the opening, latch assemblies, the component parts of which are attached to the structural part and the cover panel at two opposite sides, each assembly comprising a pilot fixed to the structural part with its axis perpendicular to the plane of the opening and with its distal end facing outwardly, each pilot having at its distal end a conical tip and rearwardly thereof a shoulder perpendicular to the axis of the pilot, a block fixed to the inner side of the cover panel containing spaced holes, the axes of which are perpendicular to the cover panel, one of said holes being of smooth bore and dimensioned to receive the pilot and the other threaded, said pilots when interengaged with the smooth bore holes aligning the cover panel with the opening so as to cover the latter, a stud screwed into the threaded hole providing a bearing, a latch member rotatably mounted on the bearing for rotation about the axis of the stud in a plane perpendicular to the axis of the stud, said arm containing intermediate its ends a concave recess for interengagement with the pilot rearwardly of the shoulder, spring means mounted on the stud with one end fixed and the other end stressed in compression against the arm at a side opposite the recess therein, said spring means biasing the arm in a direction to cause it to become engaged with the pilot behind the shoulder when the cover plate is positioned over the opening, said cover panel containing slots in alignment with the distal ends of the latch arms and knobs fixed to the distal ends of the latch arms extending through said slots.

14. A latch assembly according to claim 2 wherein the hole in the cover plate is elongate and the part fixed to the distal end of the latch which extends through the hole is movable laterally therein to disengage the latch from the shoulder.

15. A latch assembly for removably mounting a cover plate to a cabinet structure comprising a pilot fixed to the cabinet structure containing rearwardly of its distal end a portion of reduced cross section defining at the rear end a shoulder perpendicular to the axis of the pilot, a receptacle fixed to the cover plate for receiving the pilot, said pilot and receptacle, when interengaged, determining the position of the cover plate relative to the cabinet structure, a spring-biased latch member mounted to the cover plate for movement in a plane perpendicular to the axis of the part and in a position such that its distal end becomes engaged with the rear side of the shoulder in the pilot when the pilot is engaged within the receptacle, said spring-biased latch member comprising a spring finger having a coil at one end which yieldably biases the finger in a direction to enter behind the shoulder, said cover plate containing an opening in alignment with the distal end of the spring finger and means at the distal end of the spring finger which is accessible through said opening to be grasped to retract the distal end of the spring finger from behind the shoulder.

* * * * *